US005704451A

United States Patent [19]

King

[11] Patent Number: 5,704,451

[45] Date of Patent: Jan. 6, 1998

[54] LADDER STABILIZING SYSTEM

[76] Inventor: Steven L. King, 34 Plaza St. Apt. 1006, Brooklyn, N.Y. 11238

[21] Appl. No.: 771,633

[22] Filed: Dec. 20, 1996

[51] Int. Cl.[6] ..... E06C 7/00

[52] U.S. Cl. ..... 182/204; 182/111

[58] Field of Search ..... 182/200–205, 182/107, 111, 108

[56] References Cited

U.S. PATENT DOCUMENTS

| | | | |
|---|---|---|---|
| 1,592,499 | 7/1926 | Padgett | 182/203 |
| 1,651,863 | 12/1927 | Baur | 182/200 |
| 5,526,898 | 6/1996 | Clark | 182/200 |

FOREIGN PATENT DOCUMENTS

| | | | |
|---|---|---|---|
| 285440 | 9/1992 | Switzerland | 182/204 |

*Primary Examiner*—Alvin C. Chin-Shue

[57] ABSTRACT

A ladder stabilizing system including a pair of mounting assemblies coupled to a lower end of a ladder. Further provided are a pair of stabilizing mechanisms slidably engaged with respect to the mounting assemblies. A pair of feet are pivotally coupled to an associated stabilizing mechanism at a lower end thereof. The feet are adapted to pivot within a plane common to a plane defined by the vertical members of the ladder. Also included is a ladder shoe accessory comprising an elongated member having a rectangular configuration with a lower face and an upper face with a pair of elongated side faces integrally coupled between side edges of the lower face and upper face thereby defining an elongated slot. The upper face further has an elongated slit formed therein and extended between a pair of open ends of the ladder shoe accessory. The feet are adapted to be situated within the elongated slot of the first shoe accessory. Further provided is at least one stabilizer control mechanism for allowing a user to dictate the extent to which the stabilizing mechanisms extend below the ladder.

5 Claims, 3 Drawing Sheets

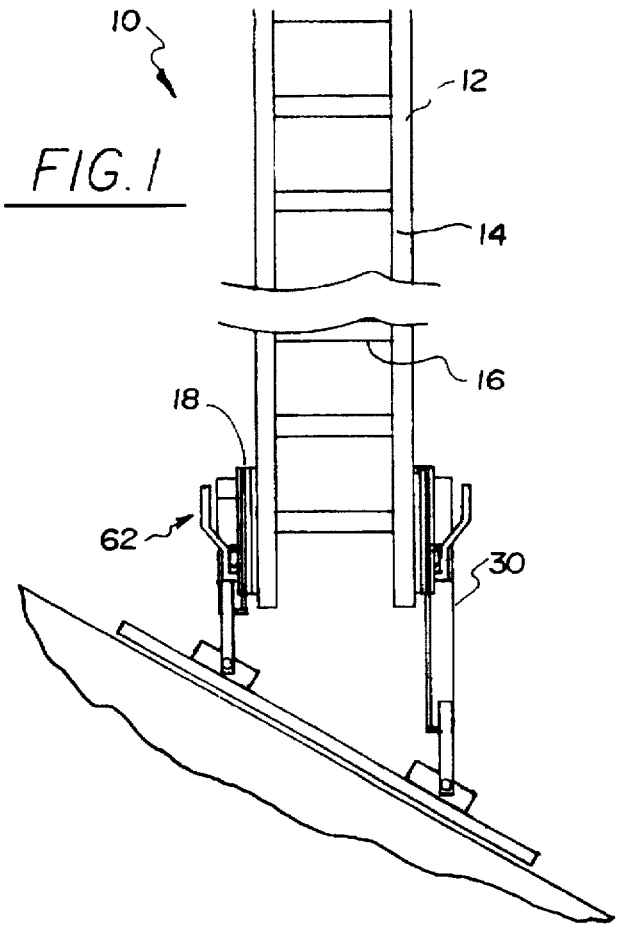
FIG. 1
FIG. 2
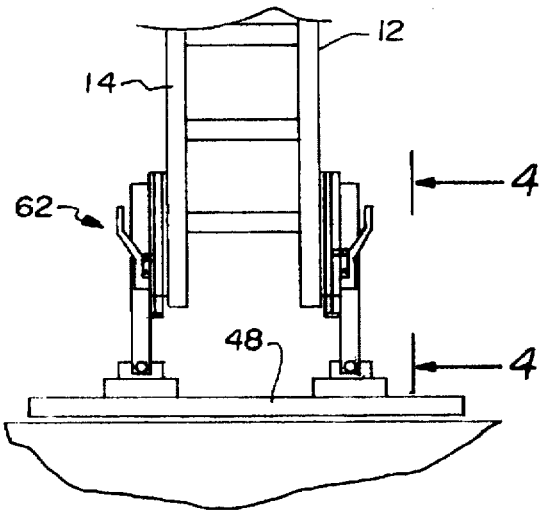
FIG. 3
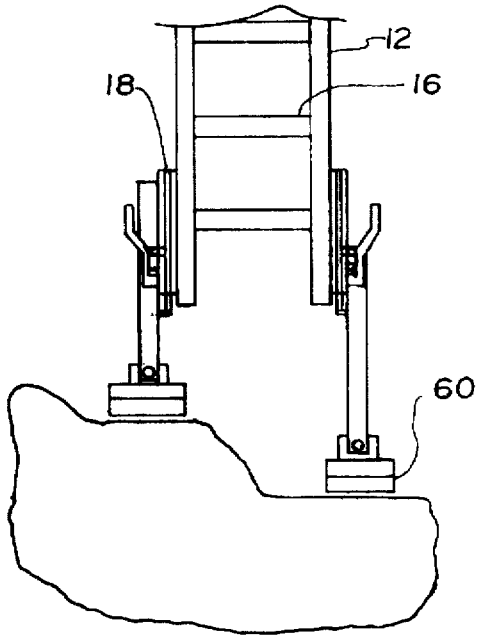

LADDER STABILIZING SYSTEM

BACKGROUND OF THE INVENTION

1. Field of the Invention

The present invention relates to a ladder stabilizing system and more particularly pertains to allowing a ladder to be utilized on various topographies.

2. Description of the Prior Art

The use of ladder stabilizers is known in the prior art. More specifically, ladder stabilizers heretofore devised and utilized for the purpose of preventing a ladder from tipping are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. Nos. 5,325,936 to Baker; 5,423,397 to Boughner; Des. 348,938 to Kennett; 5,417,302 to McElfresh; 4,798,263 to Harvey et al; and 4,580,660 to Oling.

In this respect, the ladder stabilizing system according to the present invention substantially departs from the conventional concepts and designs of the prior art, and in so doing provides an apparatus primarily developed for the purpose of allowing a ladder to be utilized on various topographies.

Therefore, it can be appreciated that there exists a continuing need for a new and improved ladder stabilizing system which can be used for allowing a ladder to be utilized on various topographies. In this regard, the present invention substantially fulfills this need.

SUMMARY OF THE INVENTION

In view of the foregoing disadvantages inherent in the known types of ladder stabilizers now present in the prior art, the present invention provides an improved ladder stabilizing system. As such, the general purpose of the present invention, which will be described subsequently in greater detail, is to provide a new and improved ladder stabilizing system which has all the advantages of the prior art and none of the disadvantages.

To attain this, the present invention essentially comprises a ladder with a pair of vertical members in parallel alignment with respect to each other. As shown in FIGS. 1–3, the ladder further has a plurality of horizontally rods perpendicularly coupled between the vertical members for stepping purposes. Further provided are a pair of mounting assemblies each including a planar back plate with a rectangular configuration. The back plate of both mounting assemblies have apertures formed in corners thereof for allowing the screwably coupling thereof to an outer surface of a corresponding vertical member of the ladder adjacent a lower end thereof, as shown in FIGS. 5 & 6. Also included as a component of each mounting assembly is a mounting sleeve with a rectangular configuration having a rear face, a front face, a pair of side faces formed therebetween with the front face defining an interior space. The front face of each mounting sleeve has a vertically extending slot formed in a central extent thereof, as shown in FIGS. 4 and 6. The front faces further define an open top face and an open bottom face of each mounting sleeve. Coupled in perpendicular relation between a central extent of the back plate and the rear face of the sleeve is a connector strip. By this design, the mounting assemblies each have an I-shaped cross-section. Slidably situated within the mounting assemblies is a pair of stabilizing mechanisms each with a T-shaped cross-section.

Each stabilizing mechanism includes a first vertically oriented plate with a second vertically oriented plate integrally coupled in perpendicular relation thereto. The first plate of each of the stabilizing mechanisms has a plurality of linearly aligned apertures formed along a length thereof on both sides of the second plate. A pair of lips are formed on a lower edge of the first plate and extend horizontally therefrom. As such, the first plate of each stabilizing mechanisms may be slidably inserted within the interior space of an associated mounting sleeve of the mounting assemblies such that the second plate extends through the slot thereof and further the lip of the first plate precludes the movement of the stabilizing mechanism upwardly through the mounting sleeve. As best depicted in FIG. 6, a pair of feet each are included each having a planar plate. A tab is integrally coupled to each planar plate in perpendicular relation therewith at a central extent thereof. The tab of each foot has an aperture formed therein for allowing pivotal coupling of the feet to an associated stabilizing mechanism at a lower end thereof. It is imperative that the rectangular plates be adapted to pivot within a plane common to a plane defined by the vertical members of the ladder. Further provided is a first ladder shoe accessory including an elongated member. Such elongated member has a rectangular configuration with a lower face, an upper face with a pair of elongated side faces integrally coupled between side edges of the lower face and upper face thereby defining an elongated slot. The upper face further has an elongated slit formed therein which extends between a pair of open ends. The elongated slot of the first shoe accessory is adapted to be situated about both of the planar plates of the feet. The first ladder shoe accessory is secured to the feet via the engagement of securement screws adapted to be selectively inserted through a threaded aperture formed in the rectangular plate of each of the feet. Associated therewith is a second ladder shoe accessory including a pair of units each with a rectangular configuration. Note FIG. 3. Each unit has a lower face and an upper face with a pair of side faces integrally coupled between side edges of the lower face and upper face thereby defining a slot. The upper face further has a slit formed therein that extends between a pair of open ends. The slots of the units of the second shoe accessory is adapted to be situated about a corresponding planar plate of the feet and further secured thereto via the engagement of the securement screws adapted to be selectively inserted through the threaded apertures formed in the rectangular plate of the feet. Finally, for allowing a user to determine the position of each of the stabilizing mechanisms independently, a pair of stabilizer control mechanisms are included. Each stabilizer control mechanism has a vertically oriented handle extent with an outboard section integrally coupled above an inboard section. As shown in FIG. 5, a plane in which the outboard section of the handle extent resides is offset from the plane associated with the inboard section thereof. The handle extent is pivotally coupled to the front face of the mounting sleeve of a corresponding mounting assembly. As shown in FIG. 4, the inboard section of each handle extent forms a fork with a pair of prongs together defining an inverted V-shaped configuration. Each stabilizer control mechanism further has a horizontally oriented pin integrally coupled to a lower end of the prong of each inboard section. The pins are adapted be releasably inserted within the apertures of the stabilizer mechanisms for allowing the stabilizing mechanisms to be fixed with respect to the mounting assembly and the ladder. The stabilizer control mechanisms each further have a pair of springs situated between the prongs of the inboard section of each of the handle extents and the front face of a corresponding mounting sleeve. By this structure, each handle extent has a biased orientation with the pins thereof disengaged from the apertures of the stabilizing mechanisms for allowing the same to be slidably situated within the mounting assembly. For precluding the stabilizing mechanism from being slidably situated within an associated mounting assembly, the stabilizer control mechanisms each have an unbiased orientation with the pins thereof engaged with the apertures of the stabilizing mechanisms.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ladder stabilizing system which has all the advantages of the prior art ladder stabilizers and none of the disadvantages.

It is another object of the present invention to provide a new and improved ladder stabilizing system which may be easily and efficiently manufactured and marketed.

It is a further object of the present invention to provide new and improved ladder stabilizing system which is of a durable and reliable construction.

An even further object of the present invention is to provide a new and improved ladder stabilizing system which is susceptible of a low cost of manufacture with regard to both materials and labor, and which accordingly is then susceptible of low prices of sale to the consuming public, thereby making such ladder stabilizing system economically available to the buying public.

Still yet another object of the present invention is to provide a new and improved ladder stabilizing system which provides in the apparatuses and methods of the prior art some of the advantages thereof, while simultaneously overcoming some of the disadvantages normally associated therewith.

Still another object of the present invention is to allow a ladder to be utilized on various topographies.

Lastly, it is an object of the present invention to provide a new and improved ladder stabilizing system including a pair of mounting assemblies coupled to a lower end of a ladder. Further provided are a pair of stabilizing mechanisms slidably engaged with respect to the mounting assemblies. A pair of feet are pivotally coupled to an associated stabilizing mechanism at a lower end thereof. The feet are adapted to pivot within a plane common to a plane defined by the vertical members of the ladder. Also included is a ladder shoe accessory comprising an elongated member having a rectangular configuration with a lower face and an upper face with a pair of elongated side faces integrally coupled between side edges of the lower face and upper face thereby defining an elongated slot. The upper face further has an elongated slit formed therein and extended between a pair of open ends of the ladder shoe accessory. The feet are adapted to be situated within the elongated slot of the first shoe accessory. Further provided is at least one stabilizer control mechanism for allowing a user to dictate the extent to which the stabilizing mechanisms extend below the ladder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an illustration of the preferred embodiment of the ladder stabilizing system constructed in accordance with the principles of the present invention, wherein the ladder is utilized on a hill.

FIG. 2 is a front view of a lower extent of the ladder and the present invention.

FIG. 3 depicts another application of the present invention.

Similar reference characters refer to similar parts throughout the several views of the drawings.

DESCRIPTION OF THE PREFERRED EMBODIMENT

Figure 4:
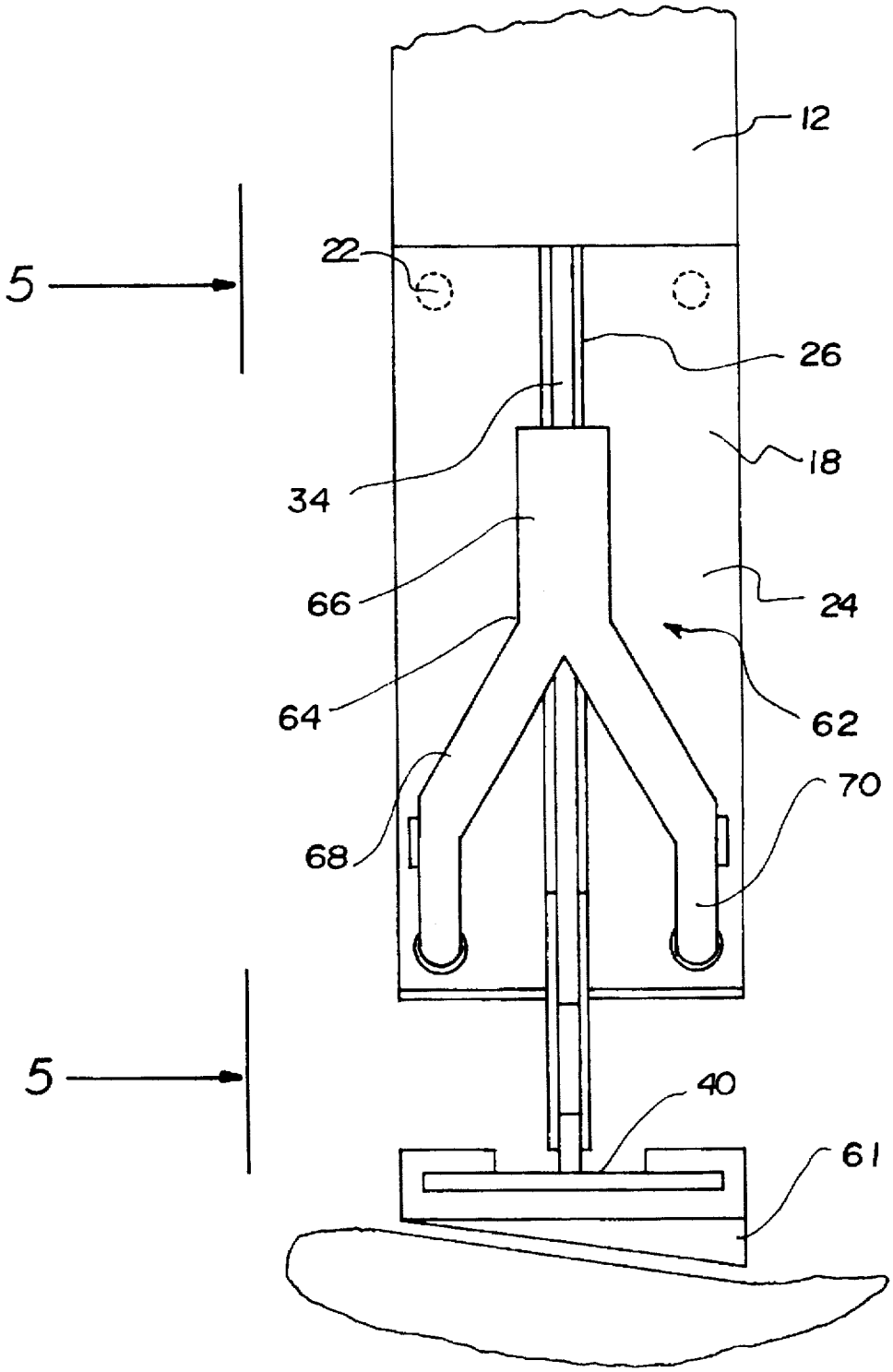
FIG. 4 is a side view of the present invention.

With reference now to the drawings, and in particular to FIG. 1 thereof, a new and improved ladder stabilizing system embodying the principles and concepts of the present invention and generally designated by the reference numeral 10 will be described.

The present invention, the new and improved ladder stabilizing system, is comprised of a plurality of components. Such components in their broadest context include a ladder, mounting assemblies, stabilizing mechanisms, feet, a pair of ladder shoe accessories, and a stabilizer control mechanism. Such components are individually configured and correlated with respect to each other so as to attain the desired objective.

More specifically, it will be noted that the system 10 of the present invention includes a ladder 12 with a pair of vertical members 14 in parallel alignment with respect to each other.

As shown in FIGS. 1–3, the ladder further has a plurality of horizontally rods 16 perpendicularly coupled between the vertical members for stepping purposes.

Figure 5:
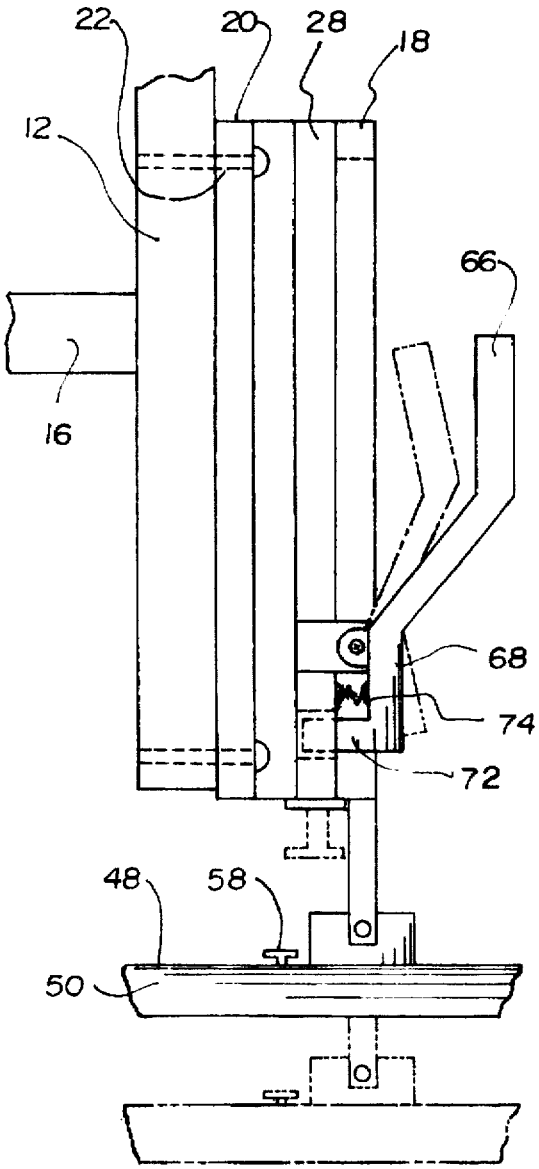
FIG. 5 is a front view of the present invention showing the two orientations of the handle extent of the stabilizer control mechanism.
Figure 6:
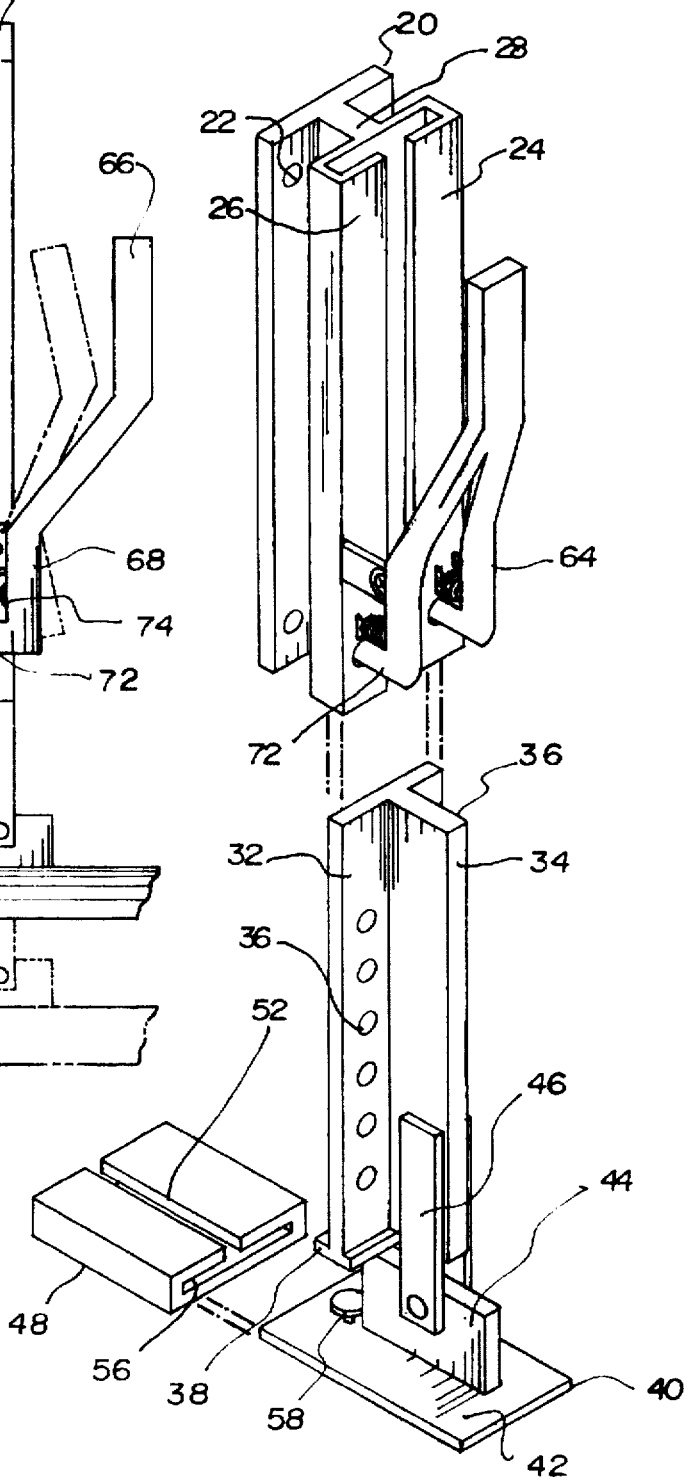
FIG. 6 is an exploded view of the present invention.

Further provided are a pair of mounting assemblies 18 each including a planar back plate 20 with a rectangular configuration. The back plate of both mounting assemblies each have apertures 22 formed in corners thereof for allowing the screwably coupling thereof to an outer surface of a corresponding vertical member of the ladder adjacent a lower end thereof, as shown in FIGS. 5 & 6. Also included as a component of each mounting assembly is a mounting sleeve 24 with a rectangular configuration having a rear face, a front face, a pair of side faces formed therebetween thereby defining an interior space. The front face of each mounting sleeve has a vertically extending slot 26 formed in a central extent thereof, as shown in FIGS. 4 and 6. The front faces further define an open top face and an open bottom face of each mounting sleeve. Coupled in perpendicular relation between a central extent of the back plate and the rear face of the sleeve is a connector strip 28. By this design, the mounting assemblies each have an I-shaped cross-section.

Slidably situated within the mounting assemblies is a pair of stabilizing mechanisms 30 each with a T-shaped cross-section. Ideally, each stabilizing mechanism is approximately 3 feet in length. Each stabilizing mechanism includes a first vertically oriented 32 plate with a second vertically oriented plate 34 integrally coupled in perpendicular relation thereto. The first plate of each of the stabilizing mechanisms has a plurality of linearly aligned apertures 36 formed along a length thereof on both sides of the second plate. For safety reasons that will become apparent later, the apertures are not present in the upper ¼ of the stabilizing mechanisms. A pair of lips 38 are formed on a lower edge of the first plate and extend horizontally therefrom. As such, the first plate of each stabilizing mechanisms may be slidably inserted within the interior space of an associated mounting sleeve of the mounting assemblies such that the second plate extends through the slot thereof and further the lip of the first plate precludes the movement of the stabilizing mechanism upwardly through the entire mounting sleeve.

As best depicted in FIG. 6, a pair of feet 40 each are included each having a planar plate 42. A tab 44 is integrally coupled to each planar plate in perpendicular relation therewith at a central extent thereof. The tab of each foot has an aperture formed therein for allowing pivotal coupling of the feet to an associated stabilizing mechanism at a lower end thereof. To accomplish such, a pair of strips 46 are coupled to opposite sides of the second plate of the stabilizing mechanism and are further extended downwardly therefrom to define a fork between which the tab may be inserted. It is imperative that the rectangular plates be adapted to pivot within a plane common to a plane defined by the vertical members of the ladder.

Further provided is a first ladder shoe accessory 48 including an elongated member 50. Such elongated member has a rectangular configuration with a lower face and an upper face with a pair of elongated side faces integrally coupled between side edges of the lower face and upper face thereby defining an elongated slot 52. The upper face further has an elongated slit 54 formed therein which extends between a pair of open ends 56. The elongated slot of the first shoe accessory is adapted to be situated about both of the planar plates of the feet. The first ladder shoe accessory is secured to the feet via the engagement of securement screws 58 adapted to be selectively inserted through a threaded aperture formed in the rectangular plate of each of the feet. Preferably, the screw is aligned with the tab such that both it and the tab is extended through the slit in use.

Associated therewith is a second ladder shoe accessory 60 including a pair of units each with a rectangular configuration. Note FIG. 3. Each unit has a lower face and an upper face with a pair of side faces integrally coupled between side edges of the lower face and upper face thereby defining a slot. The upper face further has a slit formed therein that extends between a pair of open ends of the unit. The slots of the units of the second shoe accessory is adapted to be situated about a corresponding planar plate of the feet and further secured thereto via the engagement of the securement screws which are adapted to be selectively inserted through the threaded apertures formed in the rectangular plate of the feet, similar to the use of the first ladder shoe accessory.

Situated on a lower surface of the first and second ladder shoe accessories is an elastomeric pad 61. Such pad may take many forms. As shown in FIG. 4, the pad may be beveled. In the alternative, the pad may be arcuate or simply planar in design.

Finally, for allowing a user to determine the position of each of the stabilizing mechanisms independently, a pair of stabilizer control mechanisms 62 are included. Each stabilizer control mechanism has a vertically oriented handle extent 64 with an outboard section 66 integrally coupled above an inboard section 68. As shown in FIG. 5, a plane in which the outboard section of the handle extent resides is offset from the plane associated with the inboard section thereof. Each handle extent is pivotally coupled to the front face of the mounting sleeve of a corresponding mounting assembly. As shown in FIG. 4, the inboard section of each handle extent forms a fork with a pair of prongs 70 together defining an inverted V-shaped configuration. Also shown in FIG. 4, each prong of the inboard section is pivotally coupled to the front face of the mounting sleeve on opposite sides of the slot thereof. Preferably, such coupling is positioned adjacent a bottom edge of the associated mounting sleeve. Each stabilizer control mechanism further has a horizontally oriented pin 72 integrally coupled to a lower end of each prong of the inboard section. The pins are adapted be releasably inserted within the apertures of the stabilizer mechanisms for allowing the stabilizing mechanisms to be fixed with respect to the mounting assembly and the ladder. It should be noted that a pair of bores are formed adjacent the bottom edge of the front face of each mounting sleeve to allow the passage of the pins.

The stabilizer control mechanisms each further have a pair of springs 74 situated between the prongs of the inboard section of each of the handle extents and the front face of the mounting sleeve. Ideally, the springs are position between the point of coupling of the corresponding handle extent and the pins. By this structure, each handle extent has a biased orientation with the pins thereof disengaged from the apertures of the stabilizing mechanisms for allowing the same to be slidably situated within the mounting assembly. For precluding the stabilizing mechanism from being slidably situated within an associated mounting assembly, the stabilizer control mechanisms each have an unbiased orientation with the pins thereof engaged with the apertures of the stabilizing mechanisms. As shown in FIG. 5, a user may disengage the pins by biasing the handle extent inwardly toward the ladder.

In use, a user may attach one of the ladder shoe accessories to the feet of the present invention and conveniently dictate the height of each stabilizing mechanism to accommodate various uses of the ladder. Upon the use of the first ladder shoe accessory, the stabilizing mechanisms may be extended at different lengths such that the elongated member of the accessory forms a selected angle with respect to the horizontal. The additional engagement with the ground which is afforded by the first ladder shoe accessory precludes sliding of the ladder during its use on inclines. After use, the first ladder shoe accessory may be disconnected from the ladder with the feet still situated within the slot thereof. As such, the feet may be slid to a central extent of the first ladder shoe accessory and the stabilizing mechanisms pivoted outwardly such that the second plates thereof engage the slot of the accessory, thereby affording convenient storage.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved ladder stabilizing system comprising, in combination:

a ladder with a pair of vertical members in parallel alignment with respect to each other, the ladder further having a plurality of horizontally rods perpendicularly coupled between the vertical members for stepping purposes;

a pair of mounting assemblies each including a planar back plate with a rectangular configuration having apertures formed in corners thereof for allowing screwable coupling thereof to an outer surface of a corresponding vertical member of the ladder adjacent a lower end thereof; a mounting sleeve with a rectangular configuration having a rear face, a front face, a pair of side faces formed therebetween with the front face defining an interior space and having a vertically extending slot formed in a central extent thereof, each sleeve having an open top face and an open bottom face; a connector strip with a vertical orientation integrally coupled in perpendicular relation between a central extent of the back plate and the rear face of the sleeve, wherein the mounting assemblies have an I-shaped cross-section;

a pair of stabilizing mechanisms each with a T-shaped cross-section and including a first vertically oriented plate with a second vertically oriented plate integrally coupled in perpendicular relation with the first plate, each first plate of the stabilizing mechanisms having a plurality of linearly aligned apertures formed along a length thereof on both sides of the second plate and a pair of lips extending horizontally from a lower edge of the first plate, whereby the first plate of each stabilizing mechanisms may be slidably inserted within the interior space of an associated mounting sleeve of the mounting assemblies such that the second plate extends through the slot thereof and further the lip of the first plate precludes the movement of the stabilizing mechanism upwardly through the mounting sleeve;

a pair of feet each including a planar plate with a tab integrally coupled thereto in perpendicular relation therewith in a central extent thereof, the tab of each foot having an aperture formed therein for allowing pivotal coupling of the feet to an associated stabilizing mechanism at a lower end thereof, whereby the planar plates are adapted to pivot within a plane common to a plane defined by the vertical members of the ladder;

a first ladder shoe accessory including an elongated member with a rectangular configuration having a lower face, an upper face with a pair of elongated side faces integrally coupled between side edges of the lower face and upper face thereby defining an elongated slot, the upper face further having an elongated slit formed therein and extending between a pair of open ends, the elongated slot of the first shoe accessory adapted to be situated about both of the planar plates of the feet and further secured thereto via the engagement of securement screws adapted to be selectively inserted through a threaded aperture formed in the planar plate of each of the feet;

a second ladder shoe accessory including a pair of units each with a rectangular configuration having a lower face, an upper face with a pair of side faces integrally coupled between side edges of the lower face and upper face thereby defining a slot, the upper face further having a slit formed therein and extending between a pair of open ends, the slot of the units of the second shoe accessory adapted to be situated about a corresponding planar plate of the feet and further secured thereto via the engagement of the securement screws adapted to be selectively inserted through the threaded apertures formed in the rectangular plate of the feet; and a pair of stabilizer control mechanisms each including a vertically oriented handle extent with an outboard section integrally coupled above an inboard section with the plane in which the outboard section of the handle extent resides being offset from the inboard section thereof wherein the handle extent is pivotally coupled to the front face of the mounting sleeve of a corresponding mounting assembly, the inboard section of each handle extent including a fork with a pair of prongs together having an inverted V-shaped configuration, each stabilizer control mechanism further having a horizontally oriented pin integrally coupled to a lower end of the prong of each inboard section, the pins adapted be releasably inserted within the apertures of the stabilizer mechanisms for allowing the stabilizing mechanisms to be fixed with respect to the mounting assembly and the ladder, the stabilizer control mechanisms each further having a pair of springs situated between the prongs of the inboard section of each of the handle extents and the front face of an associated mounting sleeve whereby each handle extent has a biased orientation with the pins thereof disengaged from the apertures of the stabilizing mechanisms for allowing the same to be slidably situated within the mounting assembly and an unbiased orientation with the pins thereof engaged with the apertures of the stabilizing mechanisms for precluding the same from being slidably situated within the mounting assembly.

2. A ladder stabilizing system comprising:

a ladder with a pair of vertical members in parallel alignment with respect to each other, the ladder further having a plurality of horizontally rods perpendicularly coupled between the vertical members for stepping purposes;

a pair of mounting assemblies coupled to a lower end of the vertical members of the ladder;

a pair of stabilizing mechanisms slidably engaged with respect to the mounting assemblies;

a pair of feet pivotally coupled to an associated stabilizing mechanism at a lower end thereof, whereby the feet are adapted to pivot within a plane common to a plane defined by the vertical members of the ladder;

a ladder shoe accessory including an elongated member with a rectangular configuration having a lower face and an upper face with a pair of elongated side faces integrally coupled between side edges of the lower face and upper face thereby defining an elongated slot, the elongated slot of the shoe accessory adapted to be situated about the fee; and a second ladder shoe accessory including a pair of units each with a rectangular configuration having a lower face, an upper face with a pair of side faces integrally coupled between side edges of the lower face and upper face thereby defining a slot, the upper face further having a slit formed therein and extending between a pair of open ends, the slot of the units of the second shoe accessory adapted to be situated about the feet and further secured thereto via the engagement of securement screws adapted to be selectively inserted through threaded apertures formed in the feet.

3. A ladder stabilizing system comprising:

a ladder with a pair of vertical members in parallel alignment with respect to each other, the ladder further having plurality of horizontally rods perpendicularly coupled between the vertical members for stepping purposes;

a pair of mounting assemblies coupled to a lower end of the vertical members of the ladder;

a pair of stabilizing mechanisms slidably engaged with respect to the mounting assemblies;

a pair of feet pivotally coupled to an associated stabilizing mechanism at a lower end thereof, whereby the feet are adapted to pivot within a plane common to a plane defined by the vertical members of the ladder; and a ladder shoe accessory including an elongated member with rectangular configuration having a lower face and an upper face with a pair of elongated side faces integrally coupled between side edges of the lower face and upper face thereby defining an elongated slot, the elongated slot of the shoe accessory adapted to be situated about the feet;

wherein each mounting assembly includes a planar back plate with a rectangular configuration having apertures formed in corners thereof for allowing screwable coupling thereof to an outer surface of a corresponding vertical member of the ladder adjacent a lower end thereof; a mounting sleeve with a rectangular configuration having a rear face, a front face, a pair of side faces formed therebetween with the front face defining an interior space and having a vertically extending slot formed in a central extent thereof, each sleeve having an open top face and an open bottom face; a connector strip with a vertical orientation integrally coupled in perpendicular relation between a central extent of the back plate and the rear face of the sleeve, wherein the mounting assemblies have an I-shaped cross-section.

4. A ladder stabilizing system as set forth in claim 3 wherein each stabilizing mechanism has a T-shaped cross-section and includes a first vertically oriented plate with a second vertically oriented plate integrally coupled in perpendicular relation with the first plate, each first plate of the stabilizing mechanisms having a plurality of linearly aligned apertures formed along a length thereof on both sides of the second plate and a pair of lips extending horizontally from a lower edge of the first plate, whereby the first plate of each stabilizing mechanisms may be slidably inserted within the interior space of an associated mounting sleeve of the mounting assemblies such that the second plate extends through the slot thereof and further the lip of the first plate precludes the movement of the stabilizing mechanism upwardly through the mounting sleeve.

5. A ladder stabilizing system as set forth in claim 4 and further comprising a pair of stabilizer control mechanisms each including a vertically oriented handle extent with an outboard section integrally coupled above an inboard section with the plane in which the outboard section of the handle extent resides being offset from the inboard section thereof wherein the handle extent is pivotally coupled to a front face of the mounting sleeve of a corresponding mounting assembly, the inboard section of each handle extent including a fork with a pair of prongs together having an inverted V-shaped configuration, each stabilizer control mechanism further having a horizontally oriented pin integrally coupled to a lower end of the prong of each inboard section, the pins adapted be releasably inserted within the apertures of the stabilizer mechanisms for allowing the stabilizing mechanisms to be fixed with respect to the mounting assembly and the ladder, the stabilizer control mechanisms each further having a pair of springs situated between the prongs of the inboard section of each of the handle extents and the front face of an associated mounting sleeve whereby each handle extent has a biased orientation with the pins thereof disengaged from the apertures of the stabilizing mechanisms for allowing the same to be slidably situated within the mounting assembly and an unbiased orientation with the pins thereof engaged with the apertures of the stabilizing mechanisms for precluding the same from being slidably situated within the mounting assembly.

* * * * *